US010174500B2

(12) United States Patent
Krause

(10) Patent No.: US 10,174,500 B2
(45) **Date of Patent: *Jan. 8, 2019**

(54) JAM ASSEMBLY FOR USE IN ASSOCIATION WITH AN INSULATION SYSTEM FOR BUILDINGS

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/881,914

(22) Filed: Jan. 29, 2018

(65) Prior Publication Data

US 2018/0148924 A1 May 31, 2018

Related U.S. Application Data

(63) Continuation of application No. 15/083,134, filed on Mar. 28, 2016, now Pat. No. 9,879,419, and a continuation-in-part of application No. 15/067,966, filed on Mar. 11, 2016, now Pat. No. 9,580,904.

(60) Provisional application No. 62/139,627, filed on Mar. 27, 2015, provisional application No. 62/139,628, filed on Mar. 27, 2015.

(51) Int. Cl.

| | |
|---|---|
| ***E04C 1/00*** | (2006.01) |
| ***E04B 2/58*** | (2006.01) |
| ***E04F 13/08*** | (2006.01) |
| ***E04F 13/12*** | (2006.01) |
| ***E04B 1/76*** | (2006.01) |
| *E04B 1/24* | (2006.01) |

(52) U.S. Cl.

CPC ..... *E04B 2/58* (2013.01); *E04B 1/7629* (2013.01); *E04F 13/0803* (2013.01); *E04F 13/12* (2013.01); *E04B 2001/2481* (2013.01)

(58) Field of Classification Search

CPC ..... E06B 1/56; E06B 1/04; E06B 1/52; E04B 1/74; E04B 1/62; E04B 1/762; E04B 1/7629; E04B 2001/2481; E04F 13/065; E04F 13/06; E04F 13/00; E04F 13/0891; E04F 13/0803; E04F 13/0898

USPC ... 52/309.1, 204.1, 210, 213, 204.5, 745.15, 52/741.4, 745.1

See application file for complete search history.

(56) References Cited

U.S. PATENT DOCUMENTS

| | | | | |
|---|---|---|---|---|
| 7,849,651 | B2 * | 12/2010 | Fujito | E04F 13/0889 248/216.1 |
| 9,580,904 | B2 * | 2/2017 | Krause | E04F 13/0828 |
| 9,879,419 | B2 * | 1/2018 | Krause | E04B 2/58 |

(Continued)

*Primary Examiner* — Chi Q Nguyen

(74) *Attorney, Agent, or Firm* — The Watson IP Group, PLC; Jovan N. Jovanvoic; Vladan M. Visiljevic

(57) ABSTRACT

A method of installing an insulation system proximate a jamb having steps of: providing a stud member adjacent an opening in a wall; providing and positioning an angle jamb member having a front panel portion and a side panel portion; providing a plurality of spaced apart bracket members; positioning and attaching at least one of the bracket members in a substantially parallel orientation relative to the stud member; and positioning each of a plurality of insulation panels between the at least one bracket member and the angle jamb, while being spaced apart therefrom.

12 Claims, 11 Drawing Sheets

(56) References Cited

U.S. PATENT DOCUMENTS

| | | | | |
|---|---|---|---|---|
| 2008/0008433 | A1* | 1/2008 | Parker | E04F 13/0803<br>385/128 |
| 2012/0317909 | A1* | 12/2012 | MacKenzie | E04F 13/0803<br>52/288.1 |

* cited by examiner

JAM ASSEMBLY FOR USE IN ASSOCIATION WITH AN INSULATION SYSTEM FOR BUILDINGS

CROSS-REFERENCE TO RELATED APPLICATION

This application is a continuation of U.S. patent application Ser. No. 15/083,134 filed Mar. 28, 2016, now U.S. Pat. No. 9,879,419, entitled "Jam Assembly For Use In Association With An Insulation System For Buildings, which claims priority from U.S. Provisional Patent Application Ser. No. 62/139,627 filed Mar. 27, 2015, entitled "Insulation System for Buildings In Horizontal Installations", and also U.S. Provisional Patent Application Ser. No. 62/139,628 filed Mar. 27, 2015, entitled "Insulation System for Buildings in Vertical Installations.

This application is also a continuation of U.S. patent application Ser. No. 15/067,966, filed Mar. 11, 2016, the entire disclosure of which is hereby incorporated by reference. Each of the foregoing are incorporated herein in their entirety.

BACKGROUND OF THE DISCLOSURE

1. Field of the Disclosure

The disclosure relates in general to building products, and, more particularly, to a bracket and insulation system for use and positioning on a building substrate.

2. Background Art

In the past, in order to provide a highly thermally efficient (metal) wall or (metal) roof assembly for a building enclosure, it has been necessary for metal materials, typically an exterior and interior metal skin, to be bonded to either side of an insulated panel core inside a factory thereby creating a foam panel. These metal skins are typically profiled and have offsets in them to prevent the exterior metal skin from contacting the interior metal skin. This is done in an effort to prevent metal to metal contact thereby reducing thermal conductivity from the outside of the building. Heat travels in the path of least resistance such that heat can invade a system and affect an interior atmosphere through relatively finite pathways such as fasteners and the like that have metal to metal contact with exterior conditions. Similarly, exterior exposure to cold temperatures can allow for infusion of cold temperatures into a wall construction along highly thermally conductive components.

Most applications of metal roof and wall assemblies retain at least some form of metal to metal contact through metal anchors, fasteners, or sill, transition, and window trim. Products of this type are subject to shorter warranties and life cycles due to the fact that the product is glued or otherwise bonded and is subject to damage and shortened life spans from thermal cycling which causes varying rates of contraction and expansion of the different materials and therefore wears significantly on any given system. Furthermore, these systems often require dissimilar materials to be in contact with each other which can lead to reactions such as oxidation which can corrode these materials over time. A metal wall, roof or deck system that creates a thermal break in the heat conductivity path thereby effectively eliminating or greatly reducing thermal bridging from exterior conditions to interior conditions that keeps like materials separate is desired.

Additionally, it is often necessary to provide, in addition to insulation, caulk, tape, spray membrane, sealer and/or wrap. These additional steps are often compromised during construction, and are difficult to control properly. Indeed, improperly applied wrap or tape or caulk provide passageways that disrupt the insulative properties of the building. Such installation features can be limited to openings, such as jambs and the like.

SUMMARY OF THE DISCLOSURE

The disclosure is directed to a method of installing an insulation system proximate a jamb. The method includes the steps of: providing a stud member adjacent an opening in a wall, the stud member having a side surface and a front surface; providing an angle jamb member having a front panel portion and a side panel portion; positioning the front panel portion to overlie the front face of the stud member, with the side surface of the stud member and the side panel portion of the angle jamb member substantially corresponding; extending at least one fastener through the front panel portion of the angle jamb and into the stud member to couple the angle jamb to the stud member; providing a plurality of spaced apart bracket members; positioning at least one of the plurality of space apart bracket members in a substantially parallel orientation relative to the stud member, and spaced apart therefrom so that a portion of the second end wall overlies the front panel portion of the angle jamb member, while being spaced apart from the side panel portion of the angle jamb member; attaching the at least one of the plurality of spaced apart bracket members to the stud member; and positioning the at least one of a plurality of insulation panels between the at least one bracket members, and the angle jamb member, while maintaining the at least one insulation panel spaced apart from the side panel portion of the angle jamb member.

In such a configuration, each bracket member comprises a polymer and includes an elongated body having a body wall, a first end wall extending from a first end of the body wall and a second end wall extending from the second end of the body wall opposite the first end wall. The body wall has a top surface and a bottom surface, and an upper rib extending upwardly from the top surface of the body wall spaced apart from each of the first end wall and the second end wall, and a lower rib extending downwardly from the bottom surface of the body wall spaced apart from each of the first end wall and the second end wall. Each of the upper rib and the lower rib are structurally configured to extend into the longitudinal slot of each of the plurality of insulation panels. The insertion of the respective upper rib and lower rib at least elastically deforms the longitudinal slot into which inserted so as to effectively seal along a length thereof, thereby defining a vapor barrier therebetween.

In such a configuration, each insulation panel includes a front face, a back face and a plurality of side surfaces extending therebetween. At least one of the side surfaces include a longitudinal slot extending along at least a portion thereof.

In some configurations, the method further includes the step of applying a first seal bead along the outside surface of the front panel portion of the angle jamb member.

In some configurations, the method comprises the step of applying a second seal bead along the outside surface of the front panel portion of the angle jamb member, the second seal bead being spaced apart from the first seal bead.

In some configurations, the first and second seal beads are substantially continuous along the angle jamb member, with the first and second seal beads being between the angle jamb member and the at least one bracket member.

In some configurations, the method further comprises the step of positioning the seal bead between the angle jamb member and the at least one bracket member.

In some configurations, the method includes the step of applying an expanding sealant into a slot defined by the inside surface of the side panel portion of the angle jamb member, the at least one insulation member between the at least one bracket member and the angle jamb member.

In some configurations, the method further includes the step of applying a sealing tape over the slot defined by the inside surface of the side panel portion of the angle jamb member, the front panel portion of the angle jamb member, the at least one bracket members and the at least one insulation members after the step of applying the expanding sealant.

In some configurations, the sealing tape extends at least 1 inch beyond the bracket member.

In some configurations, the method includes the steps of providing a substrate; and attaching the substrate to the stud member, prior to the step of attaching the angle jamb member to the stud member, so as to sandwich the substrate between the stud member and the angle jamb member.

In another aspect of the disclosure, the disclosure is directed to a method of installing an insulation system proximate a jamb. The method comprises the steps of: providing a stud member adjacent an opening in a wall, the stud member having a side surface and a front surface; providing an angle jamb member having a front panel portion and a side panel portion; positioning the front panel portion to overlie the front face of the stud member, with the side surface of the stud member and the side panel portion of the angle jamb member substantially corresponding; applying a first seal bead along the outside surface of the front panel portion of the angle jamb member; applying a second seal bead along the outside surface of the front panel portion of the angle jamb member, the second seal bead being spaced apart from the first seal bead; providing a plurality of spaced apart bracket members; positioning at least one of the plurality of space apart bracket members in a substantially parallel orientation relative to the stud member, and spaced apart therefrom, so that a portion of the second end wall overlies the front panel portion of the angle jamb member, while being spaced apart from the side panel portion of the angle jamb member; attaching at least one of the plurality of spaced apart bracket members to the stud member; positioning at least one of a plurality of insulation panels between the at least one bracket members, and the angle jamb member while maintaining the at least one insulation panel spaced apart from the side panel portion of the angle jamb member; and applying an expanding sealant into a slot defined by the inside surface of the side panel portion of the angle jamb member, at least one of the front panel portion of the angle jamb member, the plurality of bracket members and the plurality of insulation members.

In some configurations, the method includes the step of applying a sealing tape over the slot defined by the inside surface of the side panel portion of the angle jamb member, the front panel portion of the angle jamb member, the at least one bracket members and the at least one insulation members after the step of applying the expanding sealant.

In some configurations, the sealing tape extends at least 1 inch beyond the bracket member.

BRIEF DESCRIPTION OF THE DRAWINGS

The disclosure will now be described with reference to the drawings wherein.

DETAILED DESCRIPTION OF THE DISCLOSURE

Figure 1:
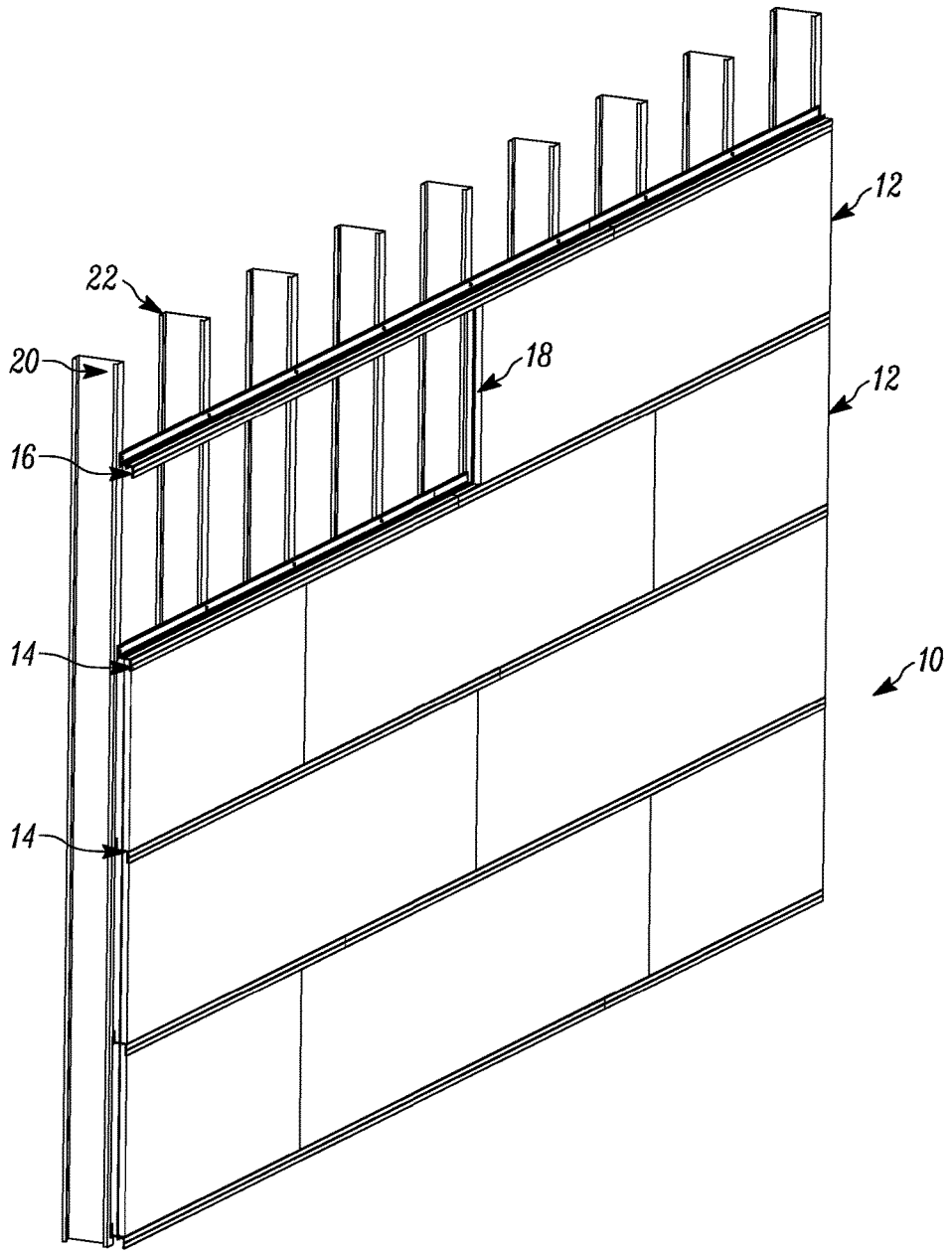
FIG. 1 of the drawings is a perspective view of a typical installation of the system of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the insulation system is shown generally at 10. The insulation system is configured for use in association with building structure 20 which includes a plurality of sidewalls, such as sidewall 22, and as well as use in association with cladding (not shown). The sidewall 22 may comprise a plurality of beams which may or may not be covered by sheet material (i.e., plywood, insulation panels, structural materials, etc.). The cladding typically comprises a substrate generally known in the industry for use in an exterior surface of a building structure such as steel, aluminum, zinc and other such substrates. Typically, the insulation system of the present disclosure is utilized between the building structure 20 and the cladding (not shown) such that the insulation system is placed on the outside of building structure with the cladding being positioned on the outside of the insulation system. The cladding is generally affixed to the insulation system. Such systems are shown in great detail in the above-incorporated patent applications.

The insulation system is shown as comprising a plurality of insulation panels 12 which are retained in position through a plurality of bracket members, such as bracket member 14 having insert rigidity members extending therethrough and a plurality of splice members, such as splice member 18. While not required, a system of the type describe hereinbelow has been tested so as to meet or exceed ASHRAE 90.1 and ASHRAE 160.

Figure 2:
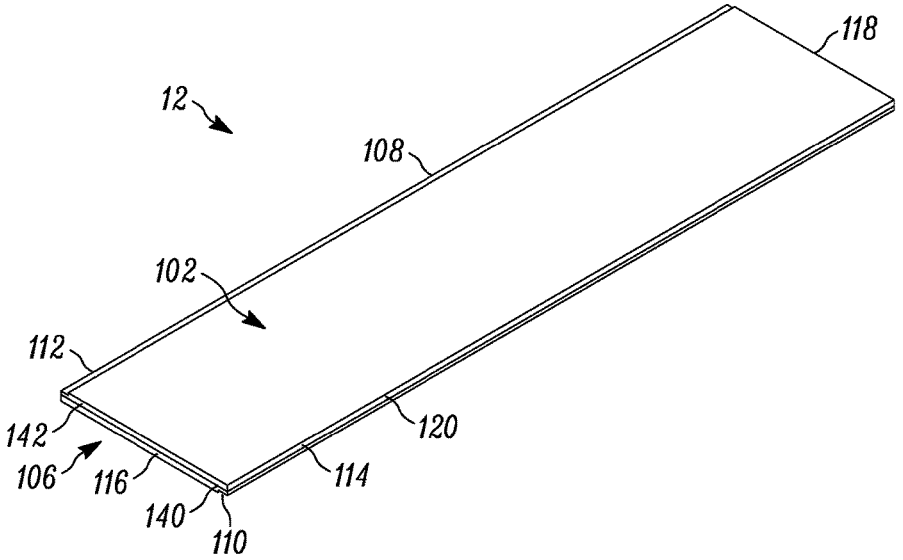
FIG. 2 of the drawings is a perspective view of the insulation panel for use in association with the insulation system of the present disclosure.
Figure 3:
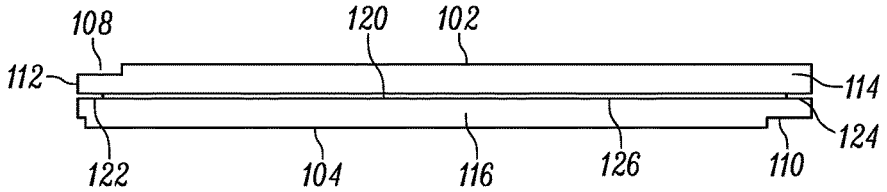
FIG. 3 of the drawings is a side elevational view of the insulation panel for use in association with the insulation system of the present disclosure.
Figure 4:
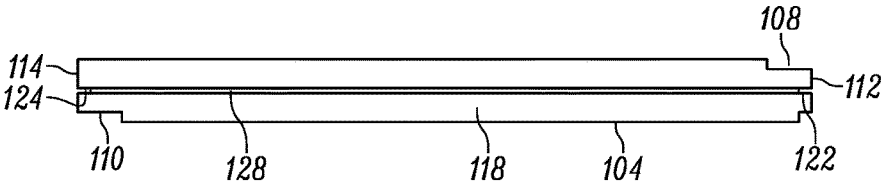
FIG. 4 of the drawings is a side elevational view of the insulation panel for use in association with the insulation system of the present disclosure.

The insulation panels 12 are shown in more detail in FIGS. 2 through 4 as comprising a generally rectangular cuboid configuration formed from a closed or open cell foam member. The foam member may be coated with a polymer coating which may have vapor barrier properties or slip resistant properties, among others. In addition, the foam member may have a vapor barrier (such as a polymer sheet or a metal foil, such as aluminum) applied in part or in whole to at least some of the surfaces thereof.

In more detail, the insulating panel can also be fire retardant panels, sound dampening panels or any other type of insulating material or panel known in the art for providing an interior or exterior wall with a quality for which the panel is known. Other such insulating materials or panels include materials having additives like insecticides, fungicides or colorants for example. Though many types of insulating materials are known in the art. For the purposes of the description below, as depicted in the accompanying figures, they are exemplified as panels, which may be sealed or unsealed, designed to insulate the building structure. Sealed panels provide a vapor barrier in the wall construction of the present disclosure. Other insulating materials suitable for use with the present disclosure include, but not be limited to, foam, fiberglass insulation, rigid insulation, semi rigid insulation, blanket insulation, loose fill insulation, spray foam in either fiberglass, rock wool, cellulose based, polystyrene, polyisocyanurate, polyurethane or other polymeric insulation formulations.

A typical one of the insulation panels 12 comprises a foam material which includes front face 102, back face 104, and side surfaces 106. The front face and the back face in the embodiment shown are generally planar surfaces which are substantially parallel to each other. In the embodiment shown, the front face 102 and the back face 104 are the same size and are generally square or rectangular. It is contemplated that other shapes and configurations are likewise contemplated. The front face 102 includes front notch portion 108. The front notch portion extends across the front face along one of the edges (that is, the edge proximate the intersection with the first end wall 112). The back face 104 includes back notch portion 110. The back notch portion extends across the back face along one of the edges (that is, the edge proximate the intersection with the second end wall 114). It will be understood that the front and back notch portions are generally of corresponding shape and on opposite ends and sides of the insulation panel 12.

The side surfaces 106 of the insulation panel 12 include first end wall 112, second end wall 114, first side wall 116 and second sidewall 118. The two end walls 112, 114 are generally parallel to each other and spaced apart from each other. The two end walls have generally the same shape. Of course, other configurations and shapes are contemplated. The two sidewalls 116, 118 are generally parallel to each other and spaced apart from each other, and, other configurations and shapes of these are likewise contemplated. In the configuration shown, the two end walls are perpendicular to the two sidewalls, forming a generally square or rectangular configuration, depending on the relative length of the end walls and the sidewalls, respectively.

Longitudinal slot 120 extends along the side surfaces 106 in an orientation substantially parallel to the front face 102 and the back face 104 spaced apart from each of these surfaces so as to be between the same. In the embodiment shown, the longitudinal slot 120 extends generally midway between the front face 102 and the back face 104, however variations are contemplated, wherein the longitudinal slot is positioned closer to either one of the front face 102 or the back face 104. It will be understood, and explained in greater detail below, that the longitudinal slot cooperates with the ribs of the bracket member 14 or the splice 18 to form a vapor barrier, and depending on the climate in which the building is located, it may be desirable to move this vapor barrier closer to either the front face or the back face of the insulation panel.

Figure 5:
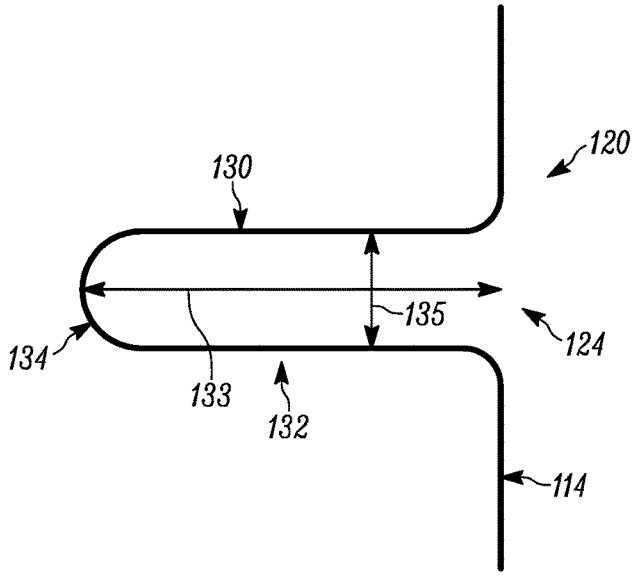
FIG. 5 of the drawings is a partial cross-sectional view of a typical portion of the longitudinal slot of the insulation panel for use with the insulation system of the present disclosure.

The longitudinal slot 120 includes first end wall slot portion 122 positioned along the first end wall 112, second end wall slot portion 124 positioned along the second end wall 114, first sidewall slot portion 126 positioned along the first sidewall 116, and second sidewall slot portion 128 positioned along the second sidewall 118. With reference to FIG. 5, showing a cross-sectional view of an exemplary one of the portions of the longitudinal slot 120, such a slot is generally of a uniform cross-sectional configuration along the length thereof. The slot includes first sidewall 130, second sidewall 132 and base portion 134. The base portion 134 joins the first sidewall 130 and the second sidewall 132 at the lower ends thereof. In the embodiment shown, the first and second sidewalls 130, 132 are of the same configuration, substantially planar and generally parallel to each other in a spaced apart fashion, to, in turn, define a slot width 135. Collectively with the base portion 134 which defines the termination of the sidewalls, the surfaces define the depth 133. As will be explained below, the cross-sectional configuration of the longitudinal slot is smaller than the corresponding portion of a rib of the bracket member 14 or the splice member 18 so as to achieve a substantially air-tight physical barrier.

Figure 10:
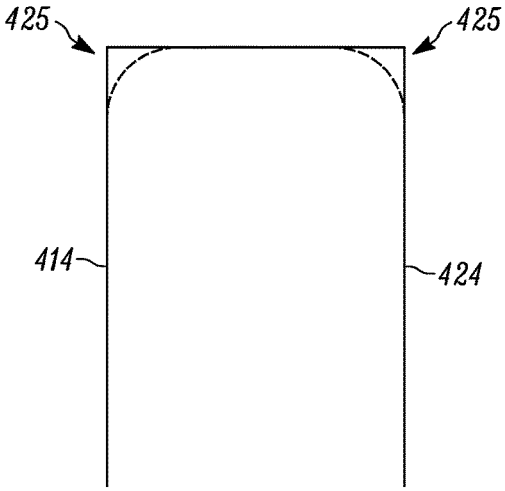
FIG. 10 of the drawings is a front plan view of the splice member for use in with the insulation system of the present disclosure, showing, in particular, the different corners that may be utilized where a sealant will be utilized, for example, rounded or square.

The insulation panel further includes adhesive system 140 (FIG. 10) which comprises adhesive beads that are disposed within the longitudinal slot 120 at strategic locations. Such strategic locations may include surfaces where air tight barriers are difficult to achieve through the interaction between the bracket member, the splice and the insulation panel. For example, adhesive beads may be positioned near the intersection of the end wall slot portions with the sidewall slot portions, so as to effectively seal, as will be explained, bracket members and splice members at the junction of the same. It will be understood that the adhesive system, it is preferred, comprises a butyl rubber or the like which is preferably pre-applied into the longitudinal slot at the desired location. Such an adhesive can be applied to the desired location, and can be maintained in such location during shipment so that the panel can be installed without further application of an adhesive in such a location. Of course, other adhesives are likewise contemplated, including, but not limited to certain gasket like materials of a soft nature.

Figure 6:
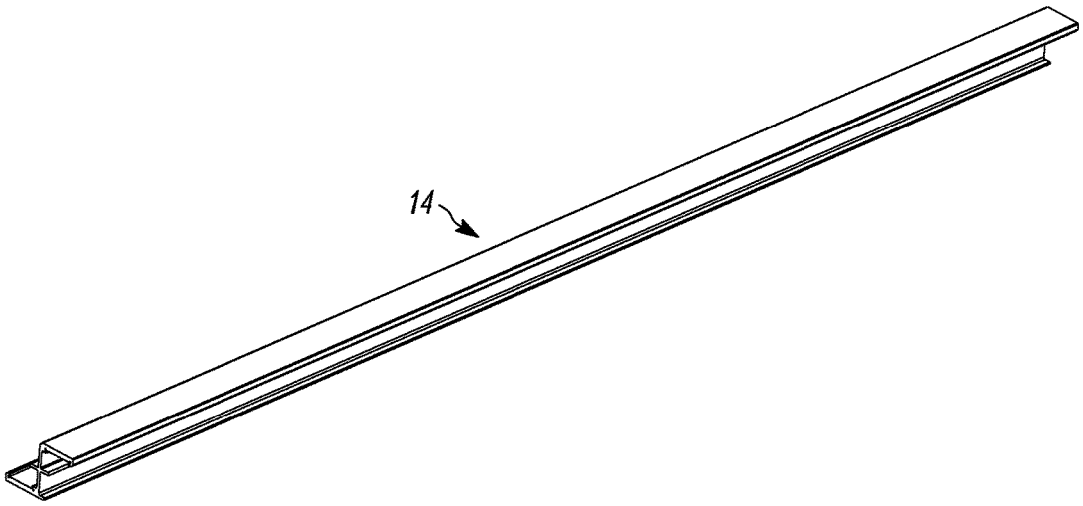
FIG. 6 of the drawings is a perspective view of the bracket member for use with the insulation system of the present disclosure.
Figure 7:
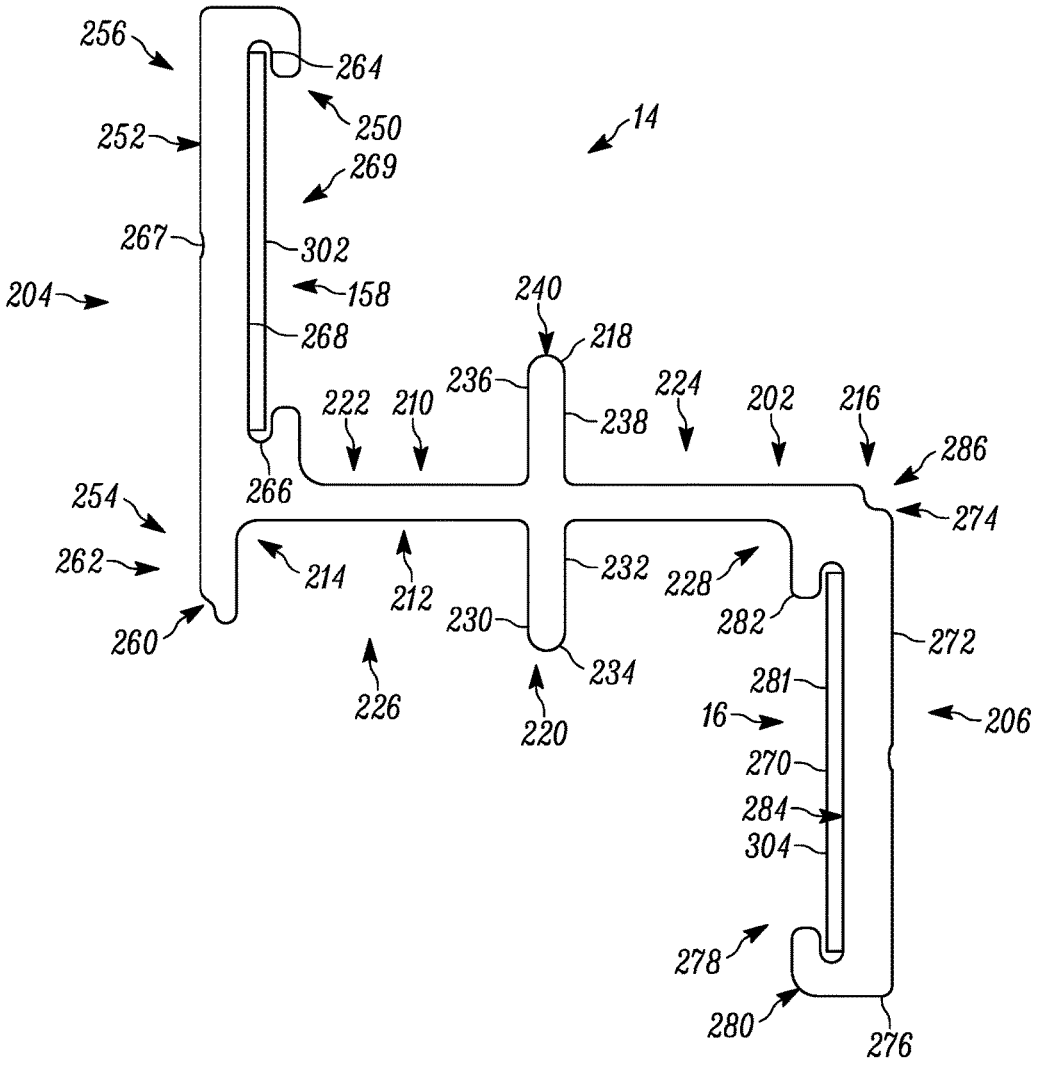
FIG. 7 of the drawings is a side elevational view of the bracket member with insert rigidity member for use with the insulation system of the present disclosure.

Bracket member 14 (also known in the industry as a "girt") is shown in FIGS. 6 and 7 as cooperating with the insert rigidity members 16. The bracket member itself comprises a polymer member, or a composite member that includes body wall 202, first end wall 204 and second end wall 206. In the embodiment shown, the first end wall 204 is generally perpendicular to the body wall 202 and the end wall 206 is likewise perpendicular to the body wall 202. It is contemplated that the bracket comprises an elongated member which is of a generally uniform cross-sectional shape, with variations that may be positioned along the length thereof.

Typically, such bracket members may be provided in any number of standard sizes that may be from only a couple of feet long to spans that are forty to fifty feet long. It is most preferred that the bracket members comprise a pulltruded profile that includes both stranded members and woven members within a resin matrix. It will be understood that the shape can be formed through one or more pulltrusion dies to achieve the final desired configuration. It is contemplated that a single resin system may be utilized, or that multiple resin systems may be utilized. Of course, the particular configuration and application may dictate changes to the relative thicknesses and dimensions of the different components. Among other fibers, it is contemplated that the fibers may comprise glass fibers (fiberglass), carbon fibers, cellulose fibers, nylon fibers, aramid fibers, and other such reinforcing fibers.

The bracket members provide a thermal break. As used herein, the term "thermal break" refers to a break in like materials wherein the material disposed between like materials is comprised of a material having low thermal conductivity such as a polymeric material having a high R-value as further described below. R-values are measurements of the thermal resistance of different materials. R-values are well known by those skilled in the art of the construction and insulation industries. A high R-value indicates a highly insulative material, such as an R-value of R.2 per inch and higher. Conductive materials have a very low R-value, such as steel which exhibits a negligible or nearly non-existent R-value. In the configuration of the present disclosure, there are no like materials in contact with one another, nor is there any metal to metal contact creating a pathway for heat to transfer from the exterior to the interior and vice versa.

It is also contemplated that the bracket members may comprise anticorrosive polymeric materials that exhibit high insulative qualities or rather, demonstrate high R-value properties such as an R-value in the range of about R.2 to about R8 per inch. Polymeric materials suitable for the present disclosure include thermoplastics or thermoset resin materials including for example: acrylonitrile-butadiene-styrene (ABS) copolymers, vinylesters epoxies, phenolic resins, polyvinyl chlorides (PVC), polyesters, polyurethanes, polyphenylsufone resin, polyarylsulfones, polyphthalimide, polyamides, aliphatic polyketones, acrylics, polyxylenes, polypropylenes, polycarbonates, polyphthalamides, polystyrenes, polyphenylsulfones, polyethersulfones, polyfluorocarbons, bio-resins and blends thereof. Other such thermoplastics and thermoplastic resins suitable for the present disclosure are known in the art which demonstrate high R-values and are thereby heat resistant as well as anticorrosive. Thermoplastics of the present disclosure are also contemplated using a recyclable polymer or are made of a polymeric material which is partially comprised of a renewable resource such as vegetable oil or the like in its composition when an eco-friendly or "green" bracket member is desired. The polymeric material of the present disclosure can also be reinforced with a reinforcing fiber as detailed below. Bracket members composed of the materials discussed above form a thermal break between exterior panels and building substrates in an effort to control the temperature within a building structure by reducing or eliminating thermal conductivity from the exterior panel to the building substrate and vice versa. In assembly, the R-value of an exterior wall panel system of the present disclosure can typically exhibit a R-value from about R.2 to about R30 per inch depending on the thickness of the overall system, the insulation materials used and the composition of the bracket members. Further, microspheres, such as polymeric or glass nanospheres, can be added to the makeup of the brackets to provide further insulative properties and increased R-value expression.

There are several different types of measurements that relate to a materials ability to insulate, resist, transmit or conduct heat across a material. Particularly, a material's K-value relates to a specific material's thermal conductivity, a material's C-value correlates to the material's thermal conductance, a material's R-value relates to a material's thermal resistance, and a U-value relates to the thermal transmittance of an overall system. In designing a wall, roof or deck bracket and panel system providing adequate insulative properties for a building structure, materials with low K-values and C-values are desired while materials with high R-values are desired. When this set of conditions is met, the overall thermal transmittance, or U-value, of the system is low. Thus, the lower the U-value, the lower the rate heat thermally bridges from one material to another. A building structure having a well insulated system will have a much lower U-value than an uninsulated or poorly insulated system exhibiting high thermal transmittance.

Regarding the R-value of the bracket members of the present disclosure, a relatively high R-value is desired to ensure adequate insulation of a building structure from outside elements by making a bracket that creates a thermal break in a wall panel system. A range of R-values for the polymeric materials used to construct the bracket members described above would be a range of about R.2 to about R8 per inch in order to create a thermal break that effectively reduces or eliminates thermal bridging. The thermal conductivity, or K-value, is the reciprocal of the material's R-value, such that for a polymeric material exhibiting an R-value of about R.2 to R8 per inch, the correlating K-value for that material would be from about K5 to about K0.125 per inch. Thus, in comparison to present day metal brackets used in other bracket and panel systems made of iron or steel, a polymeric bracket member of the present disclosure will exhibit a K-value of approximately about K.5 to about K0.125 per inch at a given set of conditions as compared to a bracket made from a metallic material such as iron or steel which would have an approximate K-value as high as K32 to K60 per inch at the same conditions. This is because metallic materials, such as iron and steel, have low or negligible R-values and are well known conductors of heat. Steel is known to have an R-value of about 0.003R per inch. Thus, for example, a steel bracket compared to a polymeric bracket of the present disclosure having an R-value of R.55 would be 183 times more thermally conductive.

The body wall 202 includes top surface 210 and bottom surface 212 which extend from first end 214 to second end 216, upper rib 218 and lower rib 220. The upper rib extends outwardly from the top surface 210 between the first and second ends, bisecting the top surface into a top first end portion 222 and a top second end portion 224. The upper rib 218 preferably extends substantially perpendicularly to the top surface 210, and, includes first side 236, second side 238 and tip region 240 spanning therebetween. The first side 236 and the second side 238 are generally parallel to each other for at least a portion of the length. The size of the upper rib 218 is that it substantially matches that of the longitudinal slots 120 of the insulation panel 12, while being slightly oversized in a number of the dimensions, if not in virtually all dimensions or all dimensions. That is, preferably, the upper rib 218 has the same shape as the longitudinal slots 120 except that it is larger dimensionally than the longitudinal slots by an amount that allows for at least elastic deformation of the longitudinal slot 120 upon insertion of the upper rib 218 therein.

The lower rib 220 preferably extends substantially perpendicularly to the bottom surface 212 of the body wall 202, and, includes first side 230, second side 232 and tip region 234. The lower rib 220 is preferably positioned on the opposite side of the upper rib 218, and has the same dimensions as the upper rib. As with the upper rib, the lower rib bisects the bottom surface 212 into a bottom first end portion 226 and a bottom second end portion 228. It will be understood that the shapes of the upper and lower rib may be varied, but where the longitudinal slots 120 are substantially uniform, the upper and lower rib are each configured to facilitate at least elastic deformation of the longitudinal slot 120 upon insertion of the upper or lower rib thereinto. It is this intimate engagement along the length thereof through the elastic deformation that provides for the sealing and, in turn, the vapor barrier on opposing sides of the rib.

The first end wall 204 is positioned at the first end of the body wall 202 and, as set forth above, is preferably perpendicular to the body wall 202. In the embodiment shown, the first end wall extends downwardly from the bottom surface 212, and projects downwardly beyond the bottom surface 212 to define a lower flange portion 262. In certain embodiments, it is helpful to line an inside surface of the lower flange portion 262 with an adhesive or sealant (such as butyl rubber). The first end wall 204 includes inside surface 250, outside surface 252, and extends from lower end 254 to upper end 256. The upper end 256 includes lower flange portion 262. It is contemplated that the lower flange portion 262 extends upwardly a distance sufficient to provide an effective surface for the application and retention of an adhesive or sealant.

The lower flange portion 262 at a lower end on the outside surface 252 thereof includes a capillary break 260 (in the form of a relief portion which tapers toward the upper edge). As set forth in the incorporated references, the capillary breaks the water tension between it and the cladding or building substrate with which it is in contact so as to act as anti-capillary action grooves for water trapped therebetween or drawn into the joints.

A first reinforcement channel 258 is defined on one of the inside surface and the outside surface of the first end wall, and preferably on the inside surface thereof. The first reinforcement channel 258 includes upper clip portion 264 and lower clip portion 266 spanned on one side by surface 268 and open to the other side defining slot 269. The channel is generally parallel to the outside surface 252 and generally extends the entirety of the inside surface 250 below the bottom surface 212 of the body wall 202.

As will be explained below, first end wall strip 302 is slidably introduced into the first reinforcement channel 258. In certain embodiments, the first end wall strip 302 is relatively snug within the first reinforcement channel 258. Preferably, the first end wall strip 302 comprises a metal member, such as an aluminum, magnesium, steel, galvanized steel or another material. Of course, it is contemplated that the first end wall strip 302 comprises a composite member of a configuration that is the same or different than that of the bracket member. It is preferred that the first end wall strip 302 comprises a member of ductility sufficient so as to receive and be pierced by a fastener or the like, while retaining the fastener therein.

It will further be understood that a guide notch 267 extends on the outside surface 252 and along the length thereof. The guide notch 267 is provided so as to provide a user with a tactile feel for where to begin the insertion of a fastener. By initiating a fastener at the guide notch, it is such that the fastener will be directed into contact at an appropriate portion of the first end wall strip 302 positioned within the first reinforcement channel 258.

The second end wall 206 as shown in FIG. 7 is positioned at the second end of the body wall 202, and is preferably perpendicular to the body wall 202 (and parallel to the first end wall 204). In the embodiment shown, the second end wall extends downwardly from the bottom surface 212 of the body wall 202.

The second end wall includes inside surface 270 and outside surface 272 which extend from inner end 274 (which is at the junction with the body wall 202), to outer end 276. A capillary break 286 having a configuration that matches the capillary break 260 of the first end wall 204.

A second reinforcement channel 278 is defined in one of the inside surface and the outside surface of the second end wall, and preferably on the inside surface thereof. The second reinforcement channel includes outer clip portion 280 and inner clip portion 282 which are spanned on one side by surface 284 and which define slot 281 on the other side thereof. The channel is generally parallel to the outside surface 272 of the second end wall, and generally extends the entirety of the inside surface below the lower surface 212 of the body wall 202.

As with the first end wall 204 above, second end wall strip 304 is slidably introduced into the second reinforcement channel 278, preferably, relatively snug therewithin. Preferably, the same materials are utilized for the second end wall strip 304 as with the first end wall strip 302.

Figure 8:
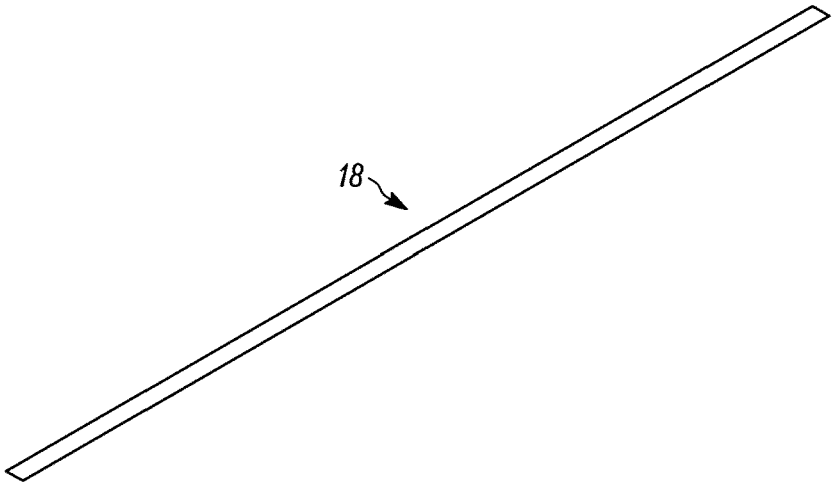
FIG. 8 of the drawings is a perspective view of the splice member for use with the insulation system of the present disclosure.
Figure 9:
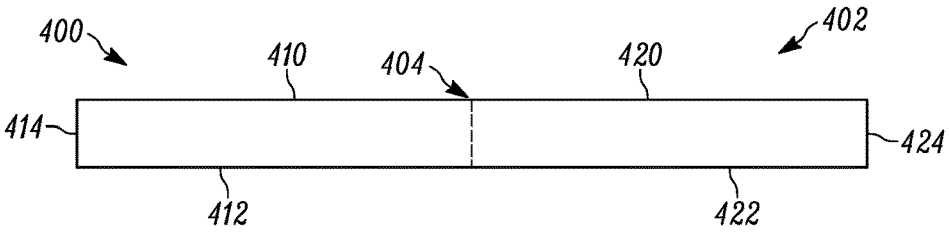
FIG. 9 of the drawings is a side elevational view of the splice member for use with the insulation system of the present disclosure.

Splice member 18 is shown in FIGS. 8, 9 and 9*a* as comprising first rib portion 400, second rib portion 402 and meeting region 404 therebetween. The first rib portion 400 includes first side 410, second side 412 and tip region 414. The first rib portion 400 generally matches the configuration of the upper rib 218 and may vary as is described above with respect to the upper rib 218. Similarly, the second rib portion 402 comprises first side 420, second side 422 and tip region 424. The second rib portion 402, as with the first rib portion, generally matches the first rib portion 400. Generally, the middle region mimics the thickness and configuration of the body wall 202 such that the relative spacing of the upper rib 218 and the lower rib 220 is generally the same as (or very similar to) the first and second rib portions 400, 402.

As with the ribs of the body wall, the first rib portion and the second rib portion provide a means by which to seal two adjoining insulation panels by being oversized, at least in some respect to the relevant longitudinal slot. In turn, at least a portion of the slot, along substantially entirely the length thereof is at least elastically deformed so as to form a substantially fluid tight configuration. Thereby, the necessary vapor barrier is formed by the combination of the splice member and the adjoining insulation panels. It will be understood that in certain embodiments, such as the embodiment of FIG. 10, the corners 425 of the splice member may be squared or may be rounded, filleted, chamfered (collectively, rounded) so as to provide a space for any sealant applied in the area of the corner to be spread and to have space for positioning. The dashed lines denote a rounded configuration, whereas the solid lines denote the squared configuration.

The assembly of an insulation system will be described with the understanding that it is merely exemplary, and that a number of variations are contemplated. Initially, a building structure 20 is provided to which the insulation system and cladding is to be applied. And, such a building structure 20 includes a plurality of sidewalls.

Figure 11:
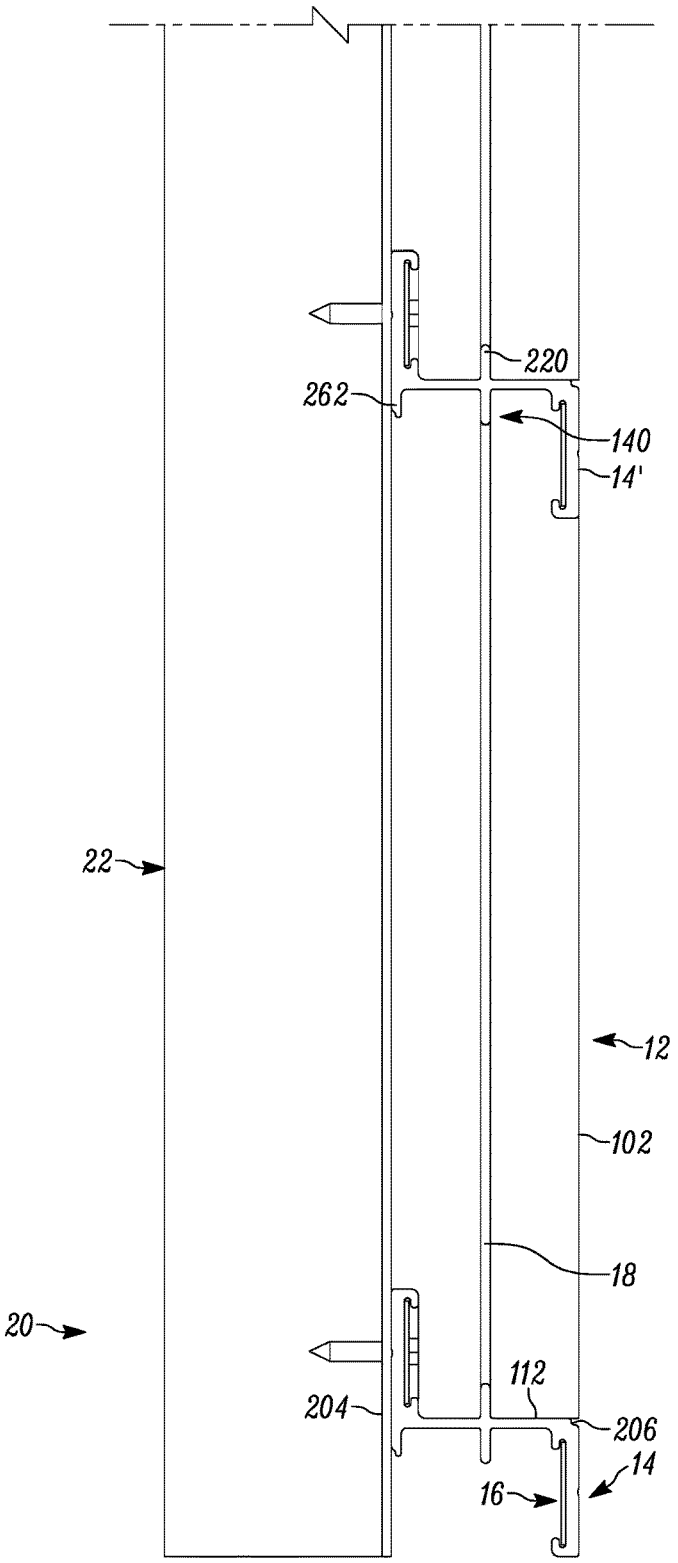
FIG. 11 of the drawings is a partial cross-sectional view of a typical installation shown in FIG. 1, showing, in particular, the installation of the splice member between adjoining bracket members and in preparation of receipt of an insulation panel.
Figure 12:
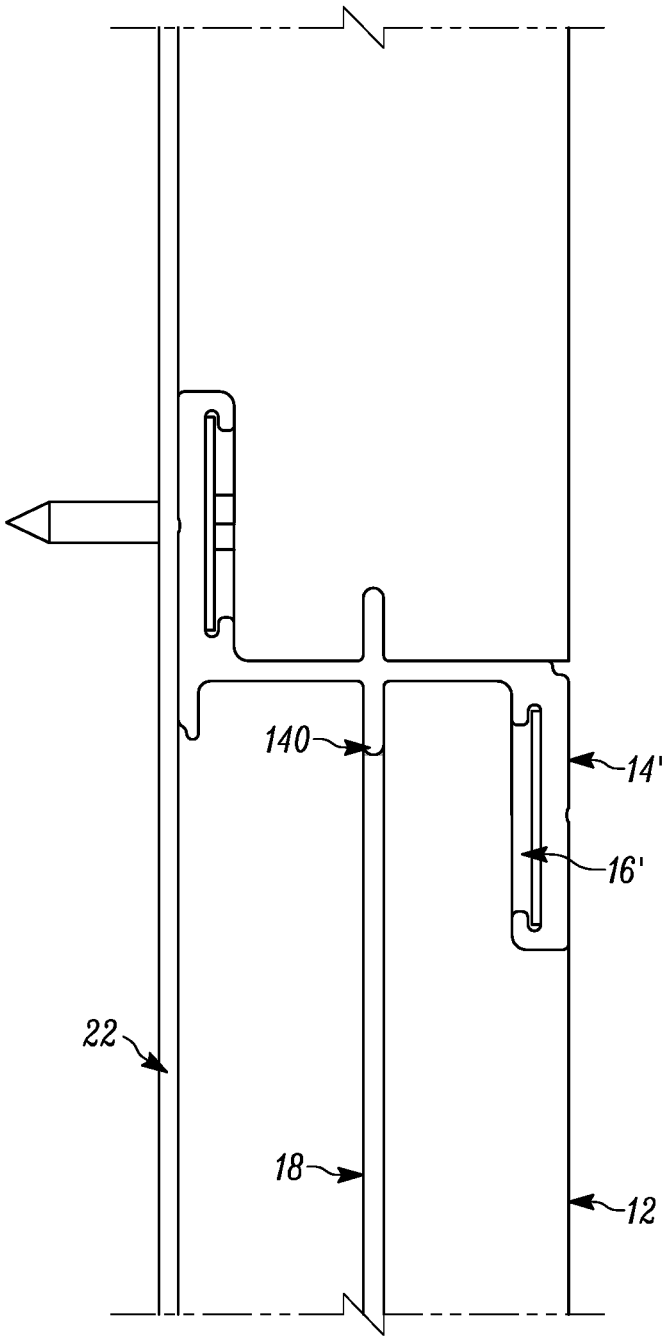
FIG. 12 of the drawings is a partial cross-sectional view of a typical installation showing, in particular, the installation of the splice member between adjoining bracket members and the inclusion of an adhesive or sealant bead.

The installer is provided the insulation system 10 (as is shown in FIGS. 1, 11 and 12) in the form of a plurality of insulation panels 12, a plurality of splice members 18 and a plurality of bracket members 14. Preferably, the insert rigidity members 16 are pre-installed with the bracket members. In certain embodiments, the insert rigidity members are installed after formation of the bracket members, whereas in other embodiments, the bracket member is formed over the insert rigidity member. Preferably, the insert rigidity member 16 is permitted to slidably move within the respective reinforcement channel 258, 278. In still other embodiments, the insert rigidity members can be inserted into the bracket members by the installer at the installation site or just prior to the installation site.

For example, a first bracket member may be positioned at the very lowest position on the sidewall of the building structure. In the embodiment shown, sidewall comprises a plurality of substantially vertical beam members (i.e., building studs). Additionally, in the embodiment shown, the studs are bare in that there is no sheeting material positioned outside of the vertical beam members. That is, the bracket members are attached directly to these underlying vertical beam members. It will be understood that these vertical beam members may comprise what is commonly known as a metal stud, or a conventional wood stud. In commercial buildings, it is more common to find a metal stud configuration, although the disclosure is not limited thereto.

In other embodiments, it will be understood that a plywood, insulation, encapsulation material among other materials may be applied to the underlying vertical beam members prior to installation of the insulation system. That is, the insulation system may be placed over a number of different building structure surfaces and compositions.

To install the first bracket member, the bracket member 14 is coupled to the building structure. It will be understood that, depending on the climate, either the first end wall 204 or the second end wall 206 can be coupled to the sidewall of the building structure. Typically, the desired orientation depends on the climate. In exceedingly cold climates, it is desirable to use a sealant in association with the upper flange portion of the first end wall 204, and, it is also desirable to place this upper flange portion as close to the building substrate (the higher heat) as practicable. As such, in such climates, the first end wall 204 is coupled to the building substrate.

In other configurations, such as in exceedingly warm climates, it is desirable to flip the bracket so that the second end wall 206 is coupled to the bracket member with the first end wall 204 coupled to the cladding. This is less significant where there will not be a sealant applied to the lower flange portion 262 of the first end wall 204. Where there is no sealant utilized with the upper flange portion, the bracket member may be installed in either direction, with a preference of coupling the first end wall 204 to the building substrate.

Referring again to the Figures, in the installation disclosed, the first end wall 204 is coupled to the building substrate. A fastener, such as a screw or the like can be utilized to couple the two components. Specifically, the screw is first pressed against the first end wall strip 302 at which time the screw pierces the strip and contacts the underlying surface 268 of the reinforcement channel 258. Further threading of the screw drives the screw through the first end wall and into the underlying building substrate. It will be understood that the first end wall strip 302 provides the necessary ductility to spread the load of the screw.

In the embodiment shown, a single bracket member is of sufficient length to span the entirety of the sidewall. In other embodiments, multiple bracket members may be required. They may be positioned in a butting configuration, side by side. In other embodiments, an adhesive or a sealant may be utilized to seal these joints. In other embodiments, such a sealant is not necessary or required.

Once a first bracket member is positioned, a plurality of insulation panels can be installed in a side by side orientation with splice members therebetween. In particular, a first insulation panel 12 is positioned as desired. In the embodiment shown, the first insulation panel 12 is positioned such that the front face 102 faces outwardly with the back face facing the building substrate. When inserted into position, the first end wall 112 extends into the slot formed by the second end wall and the building substrate. The front notch portion of the back face 104 is configured to receive the first end wall of the bracket member. As such, once positioned, the first insulation panel 12 is generally following the orientation of the bracket member.

A next step may be to add a second insulation panel next to the first in an abutting configuration. To install the second insulation panel, a preferable prerequisite is to install the splice member 18 so as to seal between the two insulation panels. To install the splice member, the first rib portion 400 is inserted into position within the first sidewall slot portion 126 so that the lower portion thereof abuts the tip region 240 of the upper rib 218. As set forth above, an adhesive or a sealant bead is positioned proximate this interface so as to achieve a seal at the abutment between the splice member 18 and the upper rib 218 of the bracket member 14. As the first rib portion 400 is sized so as to cause at least elastic deformation of the slot portion (i.e., it is undersized in at least some dimension along the length thereof), insertion requires an application of force that corresponds to the force necessary to incur the elastic deformation. Once, preferably, fully seated, the second insulation panel is installed in a manner as the first. It will be understood that the insulation panels may end at studs or may end spaced apart from studs.

Additionally, the second insulation panel is pushed toward the first insulation panel so that the second rib portion 402 extends into the corresponding longitudinal slot of the second insulation panel. As with the first rib portion 400, the second insulation panel is pushed into closer abutment with the first insulation panel 12 so as to push the second rib 402 into the proper orientation. As with the first insulation panel 12, the second insulation panel includes a bead or adhesive or sealant at the location within the slot that the upper rib 218 meets with the tip region 424 of the second rib portion 402. It will also be understood that a bead of sealant is likewise positioned proximate the distal end of each of the first rib portion 400 and the second rib portion 402 at the upper end thereof (where the splice member 18 will meet the subsequent bracket member).

Subsequent insulation panels can be installed sequentially with the splice member positioned therebetween. Once the insulation panels are installed across the bracket member, the subsequent bracket member can be coupled to the installed insulation panels and also to the building substrate. In particular, to install the subsequent bracket member, the lower rib 220 of the second bracket member 14' is inserted into the longitudinal slots of the second end wall of each of the insulation panels. Once firmly seated within the bracket member a seal is created (generally elastic deformation to at least portions of the longitudinal slot insures a substantially fluid tight seal therebetween).

Where additional sealing is desired, a sealant or adhesive may be introduced into the lower flange portion 262 of the first end wall 204 such that it fills any area and essentially seals the insulation panel and the bracket member proximate the lower flange portion 262. In certain embodiments, it may be omitted.

Subsequent insulation panels are installed in the same manner as the insulation panels described above. Successive bracket members and splices are introduced sequentially as set forth above. It will be understood that the brackets, splices and insulation panels may need to be trimmed and cut so as to be properly sized for the building and the particular location where they are installed.

Once the wall of insulation panels and bracket members is fully installed, the installer can install the cladding thereover. In particular, the cladding can be fastened with, for example, screws and the like to the bracket members, and more particularly to the first or second end wall to which the cladding is abuttingly positioned. In this manner, the fasteners that couple the cladding to the bracket member do not contact the building substrate, and the fasteners that couple the bracket member to the building substrate likewise do not contact the cladding. In this manner, the bracket members (being insulative as non-heat conducting materials) and the insulation panels form a thermal break between the cladding and the building substrate as well as insulation and vapor barrier therefor.

It will also be understood that in certain embodiments, the bracket members can be utilized in the opposite configuration (where the installation is in an excessively warm climate). In such a manner, the vapor barrier can be moved to the outside as close as possible to the cladding (especially where a bead of adhesive or sealant is utilized in conjunction with the upper flange portion 26). In other embodiments it will be understood that the splice members and the insulation panels may be omitted, and in its place a sprayed foam insulation may be applied. The bracket members provide a framework upon which the building substrate and cladding can be coupled. It will be understood that the spacing may be varied between the bracket members as can the orientation in any of the foregoing embodiments (i.e., vertical, angled, variably spaced, etc.).

In still other embodiments, the bracket members may be oriented vertically (or even at an angle). It will further be understood that such a configuration, through the use of the insert members provides a distribution of the loading throughout the bracket member that may be 3 to 5 times greater than without such an insert member. Additionally, the insert members provide an exterior metal fastening grid that is thermally isolated. It is contemplated that the system is air/water/vapor tight at a pressure of 20 pounds per square foot, and structurally wind resistant to more than 20 pounds per square foot. It is further contemplated that multiple vapor barriers of graduated permeability can be utilized.

Figure 13:
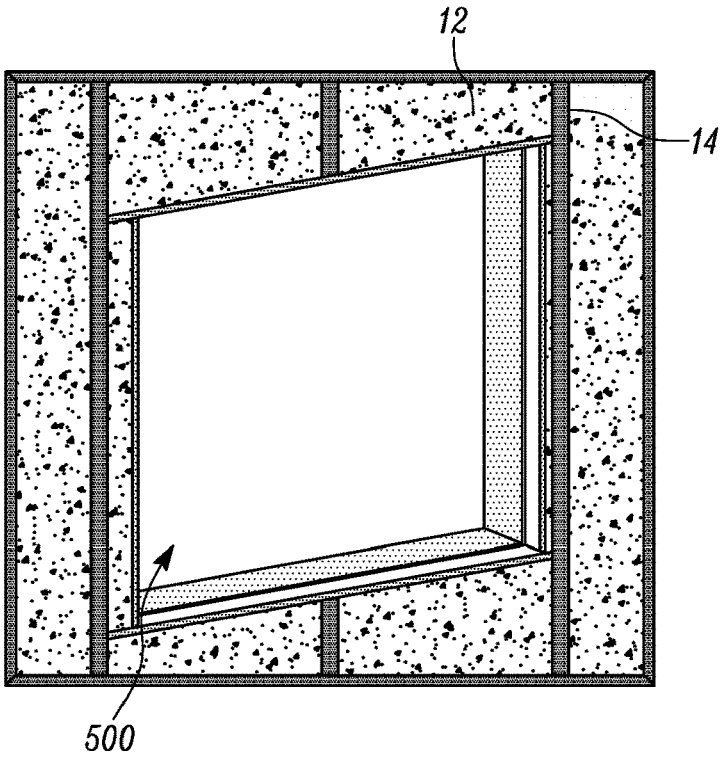
FIG. 13 of the drawings is a perspective view of an opening having two opposing jambs and upper and lower sill plates with brackets and insulation panels installed.
Figure 14:
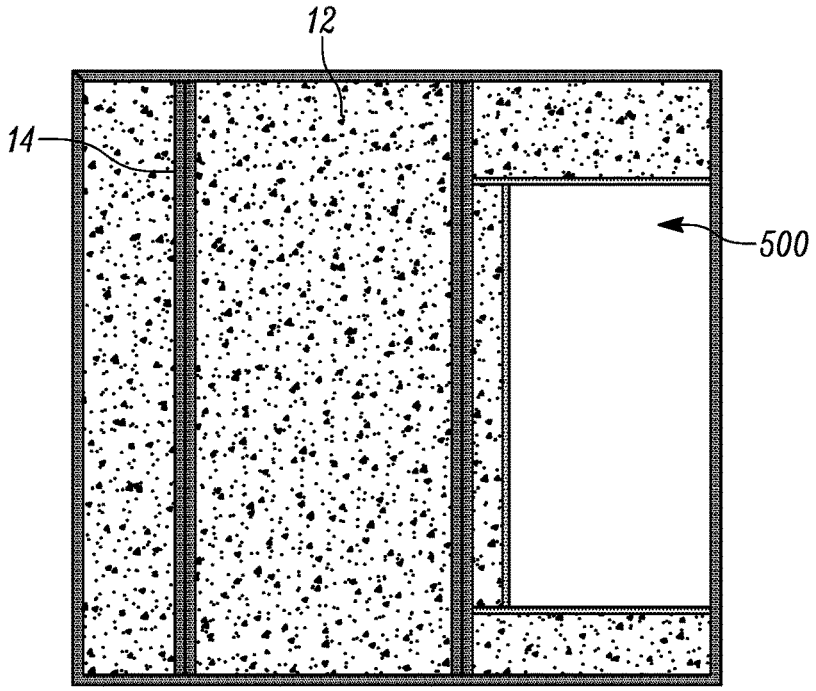
FIG. 14 of the drawings is a partial front elevational view of the opening of FIG. 13.
Figure 15:
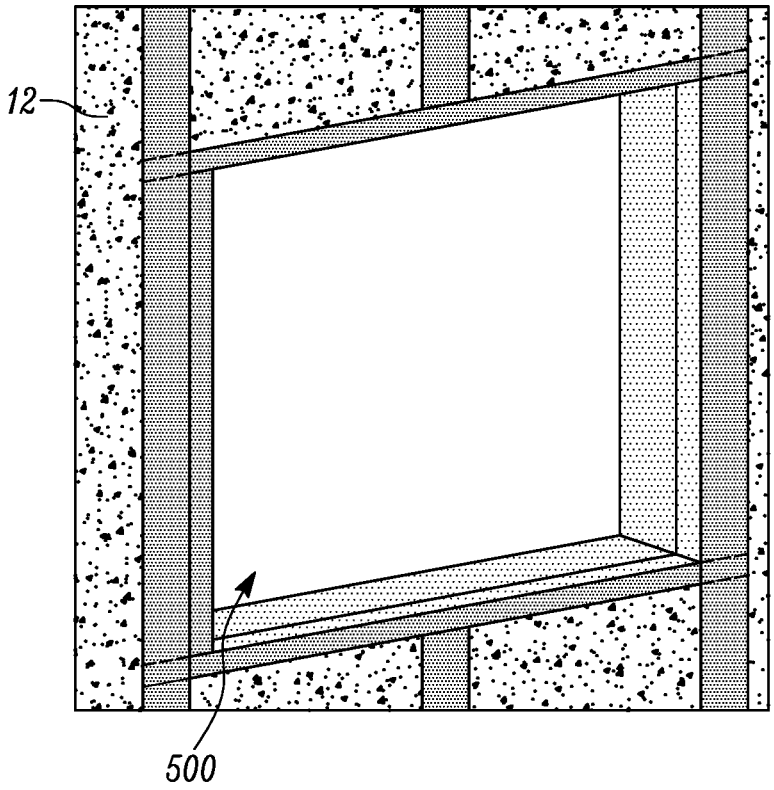
FIG. 15 of the drawings is a perspective view of the opening of FIGS. 13 and 14, having the continuous sealing tape extending over the interface between the opening and the end of the brackets and insulation panels.

With reference to FIGS. 13 through 17, a wall is shown wherein the bracket members are generally oriented vertically, and wherein an opening in the wall is presented. An improved jamb assembly, such as jamb assembly 500 can be employed. The jamb assembly is shown in a fully installed configuration in FIGS. 15, 16 and 17. The opening is shown in FIGS. 13 and 14 with the insulation and the brackets installed, and in FIG. 15 through 17 with the insulation positioned, without taping (as will be described hereinbelow).

Figure 16:
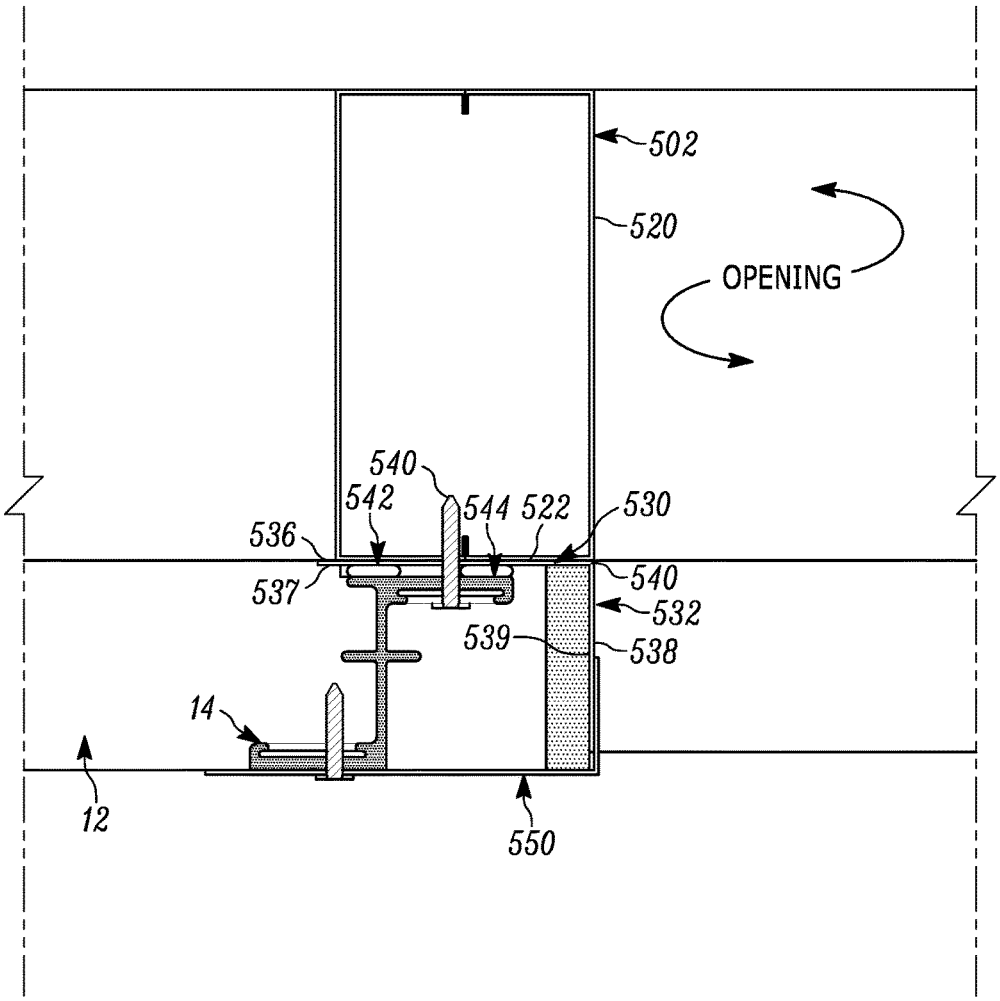
FIG. 16 of the drawings is a cross-sectional view of the jamb insulation shown in FIG. 15, showing, in particular, the interface between the stud member, the substrate positioned on the stud member, the angle jamb member, the bracket member and the insulation panel.
Figure 17:
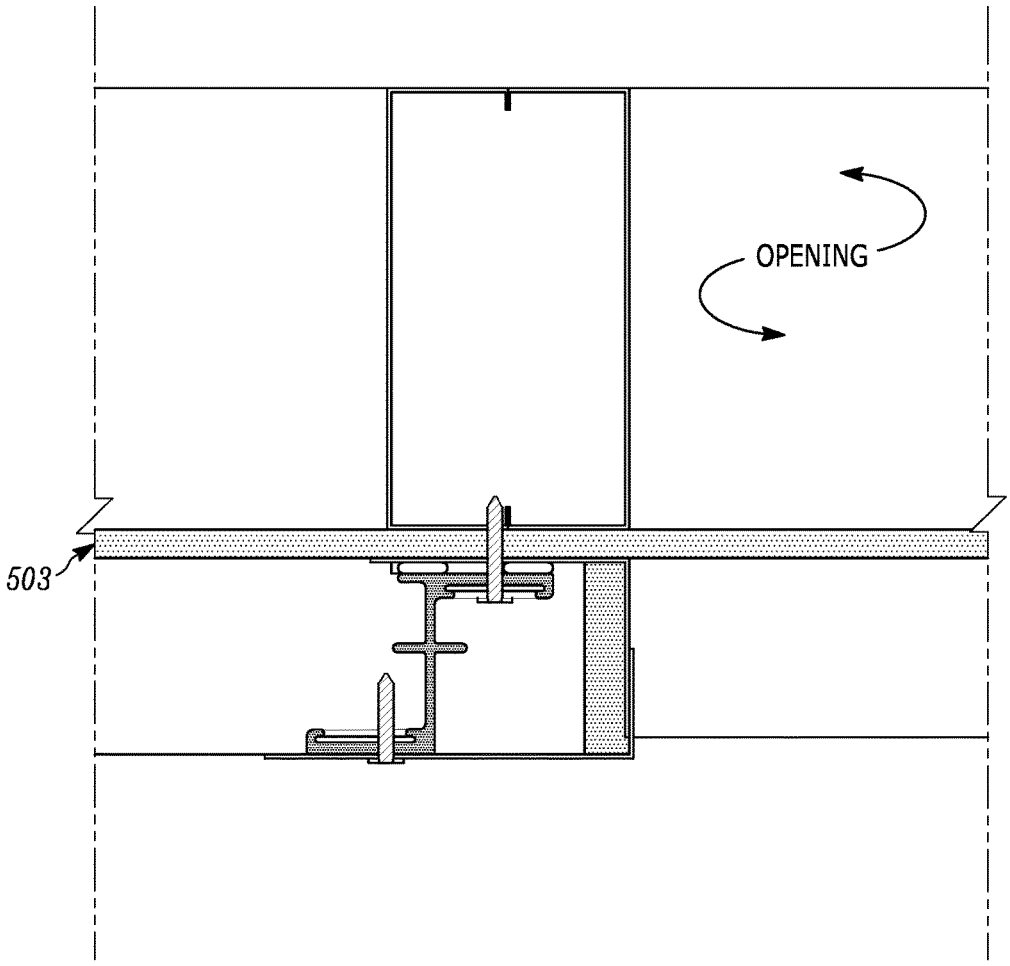
FIG. 17 of the drawings is a cross-sectional view of the jamb insulation shown in FIG. 15, showing in particular a construction like that which is shown in FIG. 16 in an alternate configuration that does not include the substrate, wherein the brackets are coupled directly to the stud member, and not to the stud member through the substrate.

With particular focus on FIG. 16, the jamb assembly 500 is shown in more detail. The jamb assembly 500 is shown as being positioned proximate to stud member (also sometimes referred to as beam) 502. The stud may comprise a metal, composite and/or wood stud member or combination of stud members, as will be understood by one of skill in the art. Additionally, a substrate 503 (FIG. 17), such as a fiberboard, particle board, plywood, among others substrates, may extend over the studs, such as stud 502. Generally, such a substrate comprises a generally uniform cross-sectional configuration. In the configuration of FIG. 16, the substrate may be omitted.

The stud member 502 includes a side surface 520 and a front surface 522. The side surface 520 generally defines the inner jam configuration. The front surface 522 defines the surface upon which the brackets are coupled. The side surface 520 defines the side wall of the jamb opening (such as, for example a window or the like).

In such a configuration the jam construction assembly further includes an angle jamb member 504. The angle jamb member includes front panel portion 530, side panel portion 532, which portions meet at corner 534. The front panel portion 530 includes outside surface 536 and inside surface 537. The side panel portion 532 includes outside surface 538 and inside surface 539. The angle jamb generally comprises a right angle bend and is positioned so that the front panel portion 530 overlies the stud member 502 (or substrate 503, if the embodiment has such a substrate). The side panel portion 532 is an extension of the side surface 520 of the stud member 502. The angle jamb member may comprise a minimum 22 Ga. Galvanized Steel, or a composite member.

A pair of seal beads 542, 544 extend along the length of the inside surface 537 of the front panel portion, each of which are on the order of ¼" wide. Of course, variations to the foregoing are contemplated. Additionally, the pair of seal beads extend over the bracket member.

Once the brackets 14 and the insulation panels 12 are installed, as described above, it is desirable to leave approximately ½" of space between the end of the insulation and the brackets and the inside surface 539 of the side panel portion. This spacing defines a substantially vertical channel formed by the angle jamb member, the bracket members and the insulation members. An expandable sealant can be introduced into this space. The expandable sealant extends into the spline groove in the insulation panels and generally extends to fill the space between the bracket members, the insulation panels and the angle jamb member, in a substantially air-tight configuration.

In the configuration shown, the body wall of the bracket shown is at least approximately 1.5" away from the end of the insulation. In such a configuration, there is at least one partial insulation panel that abuts the sealant introduced into the vertical channel. A fastener 540 is directed through the bracket at the second end wall and into the stud member 502. This compresses the seal beads 542, 544. The outer cladding can be affixed to the first end wall of the bracket.

It is preferred that a continuous 4" sealing tape 550 extend over the different panel joints, and extending over the angle jamb member 504 at least 1.5". Such a configuration provides additional protection and provides a substantially air-tight configuration. In the configuration shown, the sealing tape extends beyond the first end wall bracket by at least approximately 1".

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method of installing an insulation system proximate a jamb, the method comprising the steps of:

providing a stud member adjacent an opening in a wall, the stud member having a side surface and a front surface;

providing an angle jamb member having a front panel portion and a side panel portion;

positioning the front panel portion to overlie the front face of the stud member, with the side surface of the stud member and the side panel portion of the angle jamb member substantially corresponding;

extending at least one fastener through the front panel portion of the angle jamb and into the stud member to couple the angle jamb to the stud member;

providing a plurality of spaced apart bracket members, each bracket member comprising a polymer and including an elongated body having a body wall, a first end wall extending from a first end of the body wall and a second end wall extending from the second end of the body wall opposite the first end wall, the body wall having a top surface and a bottom surface, and an upper rib extending upwardly from the top surface of the body wall spaced apart from each of the first end wall and the second end wall, and a lower rib extending downwardly from the bottom surface of the body wall spaced apart from each of the first end wall and the second end wall, each of the upper rib and the lower rib structurally configured to extend into the longitudinal slot of each of the plurality of insulation panels, wherein the insertion of the respective upper rib and lower rib at least elastically deforms the longitudinal slot into which inserted so as to effectively seal along a length thereof, thereby defining a vapor barrier therebetween;

positioning at least one of the plurality of space apart bracket members in a substantially parallel orientation relative to the stud member, and spaced apart therefrom so that a portion of the second end wall overlies the front panel portion of the angle jamb member, while being spaced apart from the side panel portion of the angle jamb member;

attaching the at least one of the plurality of spaced apart bracket members to the stud member; and positioning at least one of a plurality of insulation panels between the at least one bracket member, and the angle jamb member, while maintaining the at least one insulation panel spaced apart from the side panel portion of the angle jamb member, each insulation panel including a front face, a back face and a plurality of side surfaces extending therebetween, at least one of the side surfaces including a longitudinal slot extending along at least a portion thereof.

2. The method of claim 1 further comprising the step of:

applying a first seal bead along the outside surface of the front panel portion of the angle jamb member.

3. The method of claim 2 further comprising the step of:

applying a second seal bead along the outside surface of the front panel portion of the angle jamb member, the second seal bead being spaced apart from the first seal bead.

4. The method of claim 3 wherein the first and second seal beads are substantially continuous along the angle jamb member, with the first and second seal beads being between the angle jamb member and the at least one bracket member.

5. The method of claim 2 further comprising the step of:

positioning the seal bead between the angle jamb member and the at least one bracket member.

6. The method of claim 1 further comprising the step of:

applying an expanding sealant into a slot defined by the inside surface of the side panel portion of the angle jamb member, the at least one insulation member between the at least one bracket member and the angle jamb member.

7. The method of claim 6 further comprising the step of:

applying a sealing tape over the slot defined by the inside surface of the side panel portion of the angle jamb member, the front panel portion of the angle jamb member, the at least one bracket member and the at least one insulation member after the step of applying the expanding sealant.

8. The method of claim 7 wherein the sealing tape extends at least 1 inch beyond the bracket member.

9. The method of claim 1 further comprising the steps of:

providing a substrate; and attaching the substrate to the stud member, prior to the step of attaching the angle jamb member to the stud member, so as to sandwich the substrate between the stud member and the angle jamb member.

10. A method of installing an insulation system proximate a jamb, the method comprising the steps of:

providing a stud member adjacent an opening in a wall, the stud member having a side surface and a front surface;

providing an angle jamb member having a front panel portion and a side panel portion;

positioning the front panel portion to overlie the front face of the stud member, with the side surface of the stud member and the side panel portion of the angle jamb member substantially corresponding;

applying a first seal bead along the outside surface of the front panel portion of the angle jamb member;

applying a second seal bead along the outside surface of the front panel portion of the angle jamb member, the second seal bead being spaced apart from the first seal bead;

providing a plurality of spaced apart bracket members, each bracket member comprising a polymer and including an elongated body having a body wall, a first end wall extending from a first end of the body wall and a second end wall extending from the second end of the body wall opposite the first end wall, the body wall having a top surface and a bottom surface, and an upper rib extending upwardly from the top surface of the body wall spaced apart from each of the first end wall and the second end wall, and a lower rib extending downwardly from the bottom surface of the body wall spaced apart from each of the first end wall and the second end wall, each of the upper rib and the lower rib structurally configured to extend into the longitudinal slot of each of the plurality of insulation panels, wherein the insertion of the respective upper rib and lower rib at least elastically deforms the longitudinal slot into which inserted so as to effectively seal along a length thereof, thereby defining a vapor barrier therebetween;

positioning at least one of the plurality of space apart bracket members in a substantially parallel orientation relative to the stud member, and spaced apart therefrom, so that a portion of the second end wall overlies the front panel portion of the angle jamb member, while being spaced apart from the side panel portion of the angle jamb member;

attaching the at least one of the plurality of spaced apart bracket members to the stud member;

positioning at least one of a plurality of insulation panels between the at least one bracket members, and the angle jamb member while maintaining the at least one insulation panel spaced apart from the side panel portion of the angle jamb member, each insulation panel including a front face, a back face and a plurality of side surfaces extending therebetween, at least one of the side surfaces including a longitudinal slot extending along at least a portion thereof;

applying an expanding sealant into a slot defined by the inside surface of the side panel portion of the angle jamb member, the front panel portion of the angle jamb member, the plurality of bracket members and the plurality of insulation members.

11. The method of claim 10 further comprising the step of:

applying a sealing tape over the slot defined by the inside surface of the side panel portion of the angle jamb member, the front panel portion of the angle jamb member, the at least one bracket members and the at least one insulation members after the step of applying the expanding sealant.

12. The method of claim 10 wherein the sealing tape extends at least 1 inch beyond the bracket member.

* * * * *